US005283227A

United States Patent [19]

Shirai et al.

[11] Patent Number: 5,283,227

[45] Date of Patent: Feb. 1, 1994

[54] THERMOSENSITIVE RECORDING MATERIAL

[75] Inventors: Ayako Shirai, Yokohama; Yoshiyuki Takahashi, Kawasaki; Kunitaka Toyofuku, Sakura, all of Japan

[73] Assignee: Oji Paper Co., Ltd., Tokyo, Japan

[21] Appl. No.: 864,751

[22] Filed: Apr. 7, 1992

[30] Foreign Application Priority Data

Apr. 18, 1991 [JP] Japan ..... 3-86774

[51] Int. Cl.[5] ..... B41M 5/30

[52] U.S. Cl. ..... 503/209; 503/216; 503/225

[58] Field of Search ..... 503/207, 209, 214, 216, 503/226

[56] References Cited

U.S. PATENT DOCUMENTS 3,859,112 1/1975 Kohmura et al. ..... 503/209

FOREIGN PATENT DOCUMENTS 196164 10/1986 European Pat. Off. .

2327135 12/1973 Fed. Rep. of Germany .

2190388 7/1990 Japan .

OTHER PUBLICATIONS

European Search Report.

*Primary Examiner*—Pamela R. Schwartz

*Attorney, Agent, or Firm*—Armstrong, Westerman, Hattori, McLeland & Naughton

[57] ABSTRACT

A thermosensitive recording material having a satisfactory high speed recording performance and whiteness and capable of forming colored images thereon having a high storage persistency for a long time, comprises a thermosensitive colored-image-forming layer formed on a sheet substrate and comprising a colorless dye precursor, a color-developing agent comprising benzyl p-hydroxybenzoate, a colored image-stabilizing agent comprising a member selected from aromatic aziridine compounds with one aziridine group and at least one aromatic cyclic group, and aromatic, aliphatic and cycloaliphatic aziridine compounds with two or more aziridine groups, and a binder.

5 Claims, No Drawings

THERMOSENSITIVE RECORDING MATERIAL

BACKGROUND OF THE INVENTION

1. Field of the Invention

The present invention relates to a thermosensitive recording material. More particularly, the present invention relates to a thermosensitive recording material free from a white powder-forming phenomenon on colored images, having a high whiteness, and capable of recording thereon colored images having an excellent persistency.

2. Description of the Related Arts

It is known that a conventional thermosensitive recording material comprises a supporting substrate, for example, a paper sheet, synthetic paper sheet, or plastic resin film, and a thermosensitive colored image-forming layer formed on a surface of the supporting substrate and comprising an electron-donative dye precursor, for example, a leuco basic dye, an electron-acceptive color-developing agent consisting of an organic acid substance, for example, a phenol compound, and a binder. When the thermosensitive colored image-forming layer is heated, colored images are recorded thereon by a reaction of the dye precursor with the color-developing agent.

This type of thermosensitive recording material is disclosed in Japanese Examined Patent Publication Nos. 43-4,160, 45-14,039 and 48-27,736, and is widely employed in practice.

Namely, the thermosensitive recording material is advantageous in that colored images can be easily formed only by heating, and the recording apparatus can be made relatively compact and small size, at a low cost, and is easily maintained, and thus is useful as an information-recording material for various outputs or printers used with, for example, computers, thermosensitive facsimile machines, automatic ticket-vending machines, scientific measurement recorders, and CRT medical measurement recorders.

Current information-recording machines can be operated at a very high speed not possible in the past, and in line with this increase in the operating speed of the information-recording machines, the thermosensitive recording material now must have a significantly enhanced thermosensitivity.

Many attempts have been made to meet the requirement of an enhanced thermosensitivity of the recording material, and among these attempts, important is a development of a new type of color-developing agent, able to replace a conventional color-developing agent, consisting of 4,4'-isopropylidenediphenol (referred to as BPA hereinafter). BPA is advantageous in that the price is low and colored images having a relatively high persistency can be formed thereon.

Nevertheless, BPA is disadvantageous in it has an unsatisfactory thermal sensitivity, due to a relatively high melting temperature of 156° C. thereof.

Many attempts have been made to provide a new type of color-developing compound usable in place of BPA, and some of those attempts are disclosed in Paper and Pulp Technology Times, Vol. 30, No. 5 (1987) to Vol. 31, No. 2 (1988). The disclosures in the above-mentioned publication, led to the development of several hundred types of compounds for BPA.

Among the new compounds, Japanese Unexamined Patent Publication (JP-A) No. 52-140,483 discloses benzyl p-hydroxybenzoate, which exhibits a high sensitivity and a high suitability for a high speed recording machine.

Although benzyl p-hydroxybenzoate effectively causes the resultant recording material to exhibit a high suitability for a high speed recording machine, the resultant colored images developed thereon are disadvantageous in that, when stored for a long time, an undesirable white powder is formed on the colored image surfaces. This phenomenon is referred to hereinafter as a white powder-forming phenomenon.

Also, the colored images exhibit an unsatisfactory resistance to oily or fatty substances and plasticizers, and therefore, if an oily or fatty substance or plasticizer-containing resin article is brought into contact with the colored images, the images fade and ultimately disappear.

Various attempts have been made to eliminate the above-mentioned disadvantages of the conventional thermosensitive recording material, by adding a phenolic antioxidant to the thermosensitive colored-image forming layer or by forming a protective surface layer on the thermo-sensitive colored image-forming layer.

For example, Japanese Unexamined Patent Publication Nos. 60-78,782, 59-167,292, 59-114,096 and 59-93,387 disclose a thermosensitive colored image-forming layer containing a phenolic antioxidant.

Japanese Unexamined Patent Publication No. 56-146,796 discloses a protective layer formed from a hydrophobic polymeric compound emulsion on a thermosensitive colored image-forming layer.

Japanese Unexamined Patent Publication No. 58-199,189 discloses an intermediate layer formed from a water-soluble polymeric compound solution or a hydrophobic polymeric compound emulsion on a thermosensitive colored image-forming layer, and a protective surface layer formed by applying an oil paint containing, as a resinous component, a hydrophobic polymeric material on the intermediate layer.

In the thermosensitive colored image-forming layer containing, as a color-developing agent, benzyl p-hydroxybenzoate, the addition of the phenolic antioxidant, which effectively enhances a resistance of the resultant colored images to oily or fatty substance or to a plasticizer, is disadvantageous in that the resultant thermosensitive colored image-forming layer is easily stained in the ground thereof, and thus exhibits a lowered whiteness, and when stored at a relatively high temperature, for example, about 60° C., non-color-developed portions of the colored image-forming layer exhibit an undesirably increased color density.

Also, the improvement in the resistance of the resultant colored images to oily or fatty substances or a plasticizer, due to the phenolic antioxidant, is still not satisfactory.

Furthermore, the phenolic antioxidant does not satisfactorily inhibit the white power-forming phenomenon on the resultant colored image surface.

Also, the arrangement of the protective layer on the colored image-forming layer does not result in a satisfactory persistency of the resultant colored images under high temperature-high humidity conditions.

Further, when a recording material having a protective layer formed on a colored image-forming layer is subjected to a cutting procedure or an adhering procedure, an oily or fatty substance penetrates the colored image-forming layer through the cut edges thereof, and thus the resultant colored images fade and ultimately disappear. Therefore, the protective layer cannot completely eliminate the disadvantages of the conventional recording sheet.

SUMMARY OF THE INVENTION

An object of the present invention is to provide a thermosensitive recording material having a high suitability for a high speed recording machine, a high whiteness, and an enhanced capability of forming colored images having an excellent resistance to oily and fatty substances, plasticizers, heat and moisture, and thus exhibiting a superior persistency in the ambient atmosphere for a long time.

Another object of the present invention is to provide a thermosensitive recording material useful for thermorecording type tickets of automatic ticket machine, for commuter's passes, and for coupon tickets, which must have a high persistency, in terms of the quality of the colored images recorded thereon, for a long time, for label sheets in a POS bar code price-indicating system, to be attached to a surface of a polyvinyl chloride film containing a plasticizer and wrapping fresh food or meat containing an oily or fatty substance, which label sheets are unavoidably brought into contact with the plasticizer and/or the oily or fatty substance, for facsimile printers, word processor printers and video printers, and for CRT image-printers.

The inventors of the present invention made many attempts to eliminate the disadvantages of the conventional thermosensitive recording material, and found that a new type of thermosensitive recording material in which a thermosensitive colored image-forming layer thereof contains a specific aziridine compound in combination with benzyl p-hydroxybenzoate exhibits an enhanced suitability for a high speed recording machine, a high whiteness, and an improved capability of forming colored images having an excellent persistency.

Namely, the above-mentioned objects can be attained by the thermosensitive recording material of the present invention comprising a sheet substrate; and a thermosensitive colored image-forming layer formed on the sheet substrate and comprising a substantially colorless dye precursor, a color-developing agent reactive with the dye precursor upon heating to develop a color, and a binder, said color-developing agent comprising benzyl p-hydroxybenzoate, and said thermosensitive colored image-forming layer further containing a colored image-stabilizing agent comprising at least one aziridine compound selected from the group consisting of aromatic aziridine compounds having, per one molecule thereof, an aziridine group and at least one aromatic cyclic group, and aromatic, aliphatic and cycloaliphatic aziridine compounds having, per one molecule thereof, at least two aziridine groups.

The aziridine group, i.e., ethyleneimine group, is of the formula:

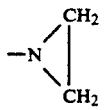

which will be represented by an abbreviated formula:

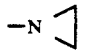

DESCRIPTION OF THE PREFERRED EMBODIMENTS

In the thermosensitive recording material of the present invention, a thermosensitive colored image-forming layer is arranged on a surface of a sheet substrate, and comprises a substantially colorless dye precursor, a color-developing agent comprising benzyl p-hydroxybenzoate, a binder, and a colored-image-stabilizing agent comprising at least one aziridine compound.

The above-mentioned specific thermosensitive colored image-forming layer can provide thereon clear colored images having a superior resistance to oily and fatty substances, plasticizers, heat and moisture, and thus an excellent persistency, in terms of the quality of the colored images, for a long time, without a white powder-forming phenomenon occurring on the colored images.

The benzyl p-hydroxybenzoate is effective, as a color-developing agent, for forming clear colored images having a satisfactory color density at a high thermal sensitivity.

The aziridine compound is effective, as a colored image-stabilizing agent, for enhancing the resistance of the resultant colored images to oily and fatty substances, plasticizers, heat, moisture and other environmental conditions, and for inhibiting the white powder-forming phenomenon on the colored images.

The reasons for which the colored images on the thermosensitive colored image-forming layer of the present invention containing the specific aziridine in combination with benzyl p-hydroxybenzoate exhibits an enhanced persistency for a long time is not completely clear, but it is assumed that the aziridine compound, which has a highly reactive aziridinyl group, addition-reacts with the dye precursor and benzyl p-hydroxybenzoate, and the resultant addition-reaction product prohibits a crystallization of benzyl p-hydroxybenzoate, which causes the undesirable white powder-forming phenomenon, and prevents a restoration of a color-developed dye in a ring-opened structure to a colorless dye precursor in a ring-closed structure.

The aziridine compounds usable for the present invention are preferably colorless or light colored aziridine compounds having a melting point of 50° C. or more, and thus in the state of a solid at room temperature. The aziridine compounds can be prepared by a reaction of ethyleneimine with a member selected from halogenated alkyl compounds, halogenated allyl carboxylic acid halides, halogenated carbonic acid esters, halogenated phosphonium compounds, halogenated sulfonium compounds, epoxy compounds, isocyanate compounds, isothiocyanate compounds, ketene compounds, carbodiimide compounds and olefin compounds.

The aziridine compounds usable for the present invention are selected from the group consisting of aromatic aziridine compounds having, per one molecule thereof, an aziridine group and at least one aromatic cyclic group, and aromatic, aliphatic and cycloaliphatic aziridine compounds having, per one molecule thereof, at least two aziridine groups.

The aziridine compounds usable for the present invention are preferably selected from the specific compounds of the following formulae (1) to (78).
| Compound No. | Formula |
|---|---|
| 1) | 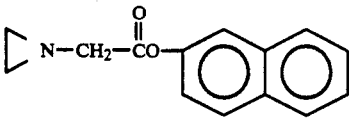 |
| 2) | 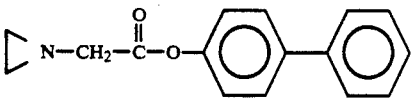 |
| 3) | 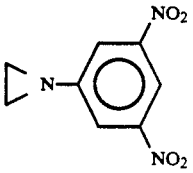 |
| 4) | 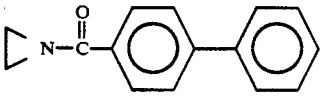 |
| 5) | 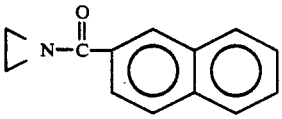 |
| 6) | 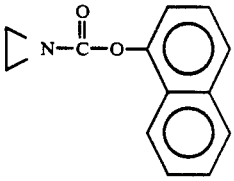 |
| 7) | 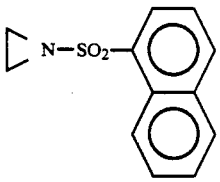 |
| 8) | 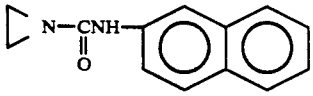 |
| 9) | 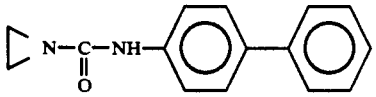 |
| 10) | 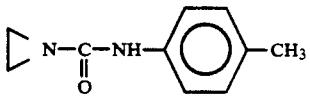 |
| 11) | 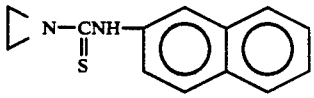 |

-continued
| Compound No. | Formula |
|---|---|
| 12) | 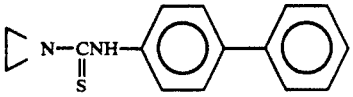 |
| 13) | 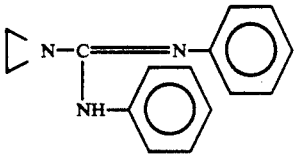 |
| 14) | 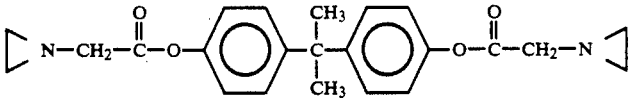 |
| 15) | 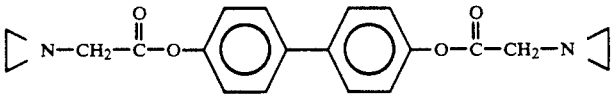 |
| 16) | 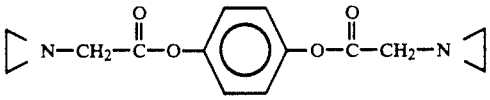 |
| 17) | 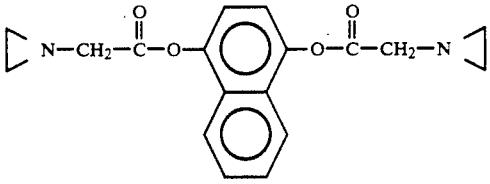 |
| 18) | 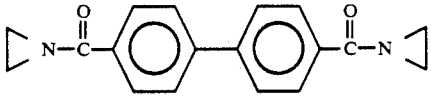 |
| 19) | 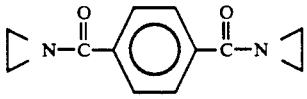 |
| 20) | 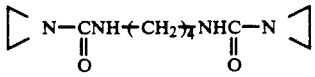 |
| 21) | 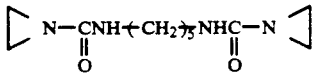 |
| 22) | 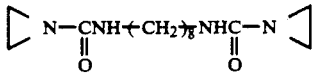 |
| 23) | 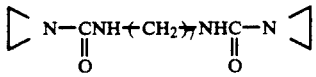 |
| 24) | 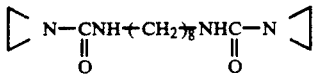 |

-continued
| Compound No. | Formula |
|---|---|
| 25) | 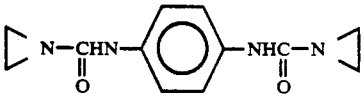 |
| 26) | 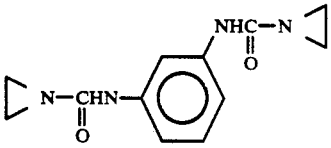 |
| 27) | 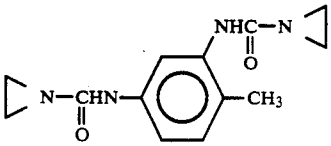 |
| 28) | 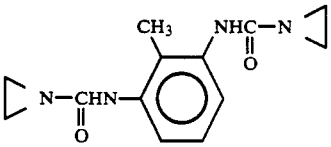 |
| 29) | 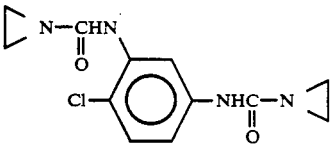 |
| 30) | 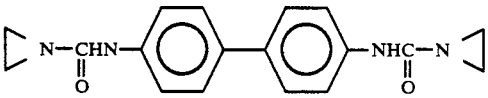 |
| 31) | 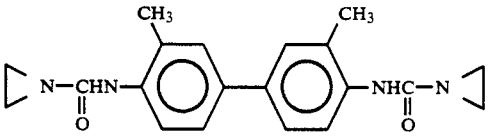 |
| 32) | 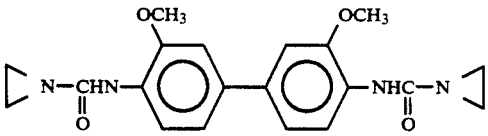 |
| 33) | 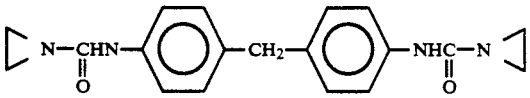 |
| 34) | 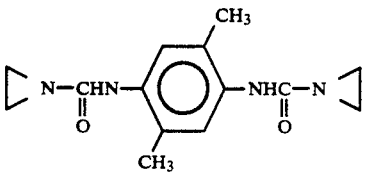 |

-continued
| Compound No. | Formula |
|---|---|
| 35) | 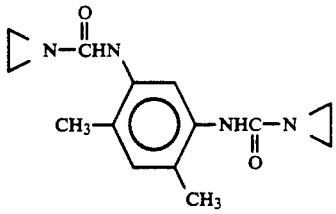 |
| 36) | 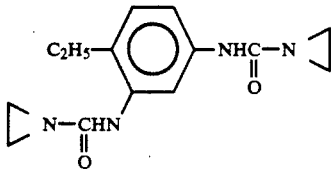 |
| 37) | 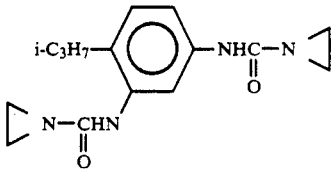 |
| 38) | 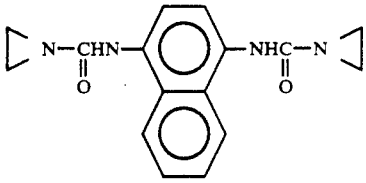 |
| 39) | 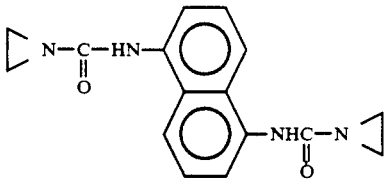 |
| 40) | 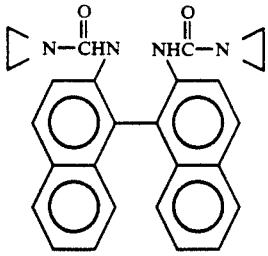 |
| 41) | 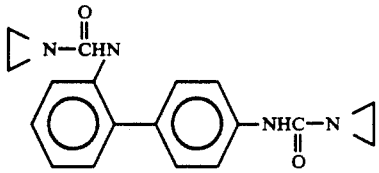 |
| 42) | 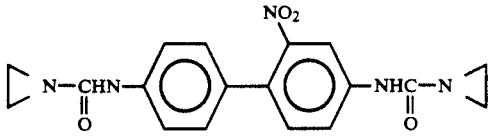 |

-continued
| Compound No. | Formula |
|---|---|
| 43) | 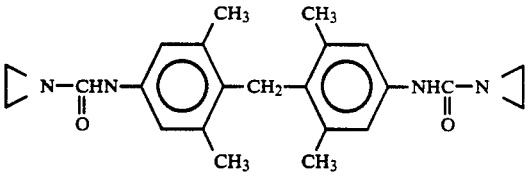 |
| 44) | 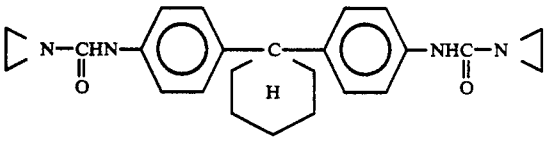 |
| 45) | 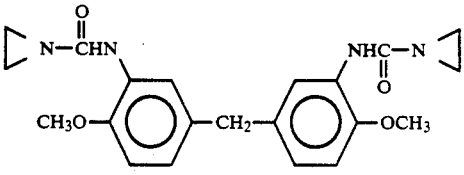 |
| 46) | 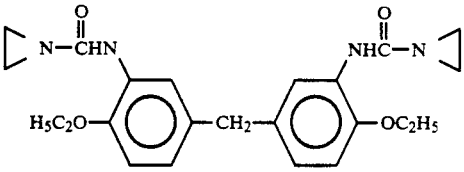 |
| 47) | 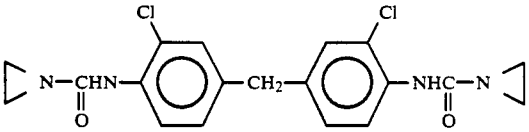 |
| 48) | 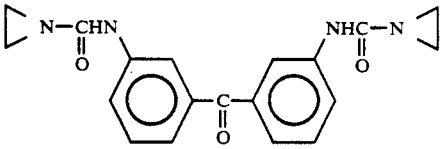 |
| 49) | 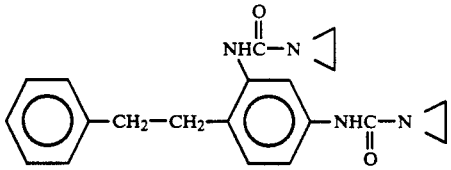 |
| 50) | 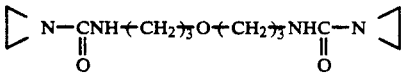 |
| 51) | 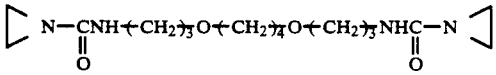 |
| 52) | 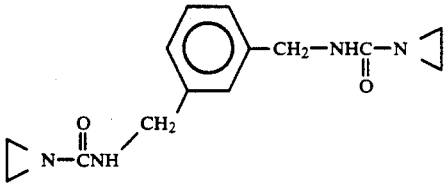 |

-continued
| Compound No. | Formula |
|---|---|
| 53) | 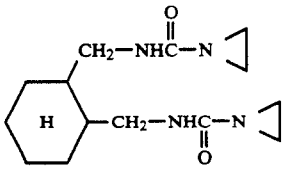 |
| 54) | 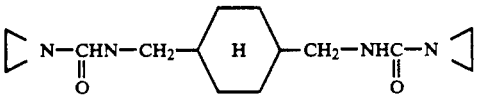 |
| 55) | 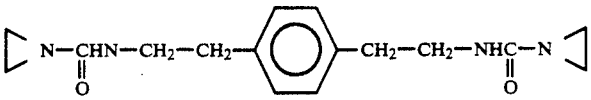 |
| 56) | 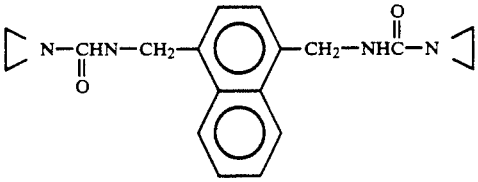 |
| 57) | 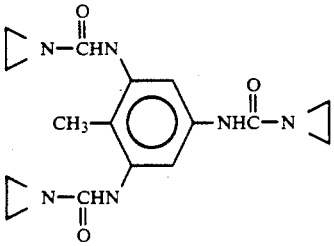 |
| 58) | 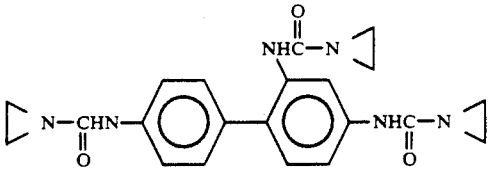 |
| 59) | 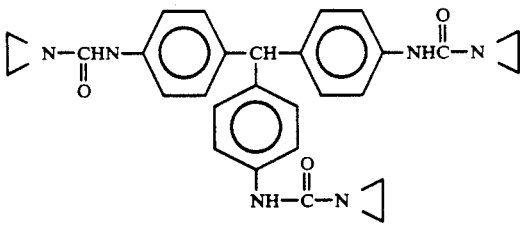 |
| 60) | 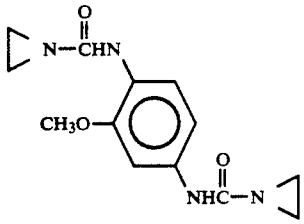 |
| 61) | 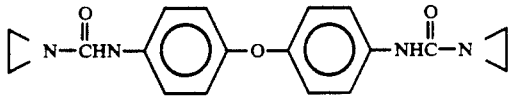 |

-continued
| Compound No. | Formula |
|---|---|
| 62) | 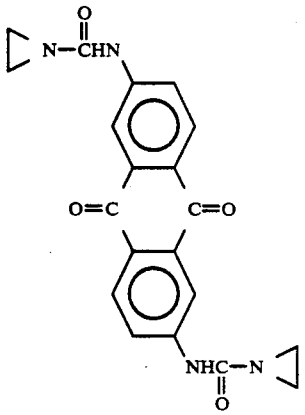 |
| 63) | 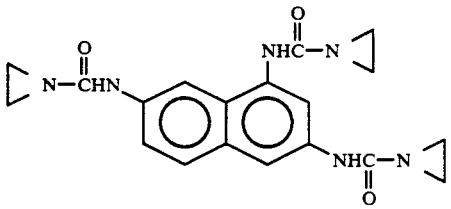 |
| 64) | 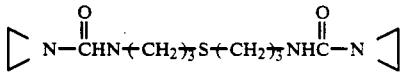 |
| 65) | 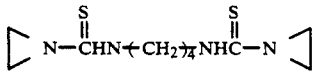 |
| 66) | 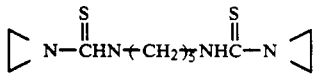 |
| 67) | 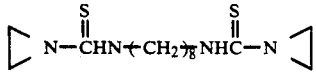 |
| 68) | 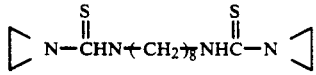 |
| 69) | 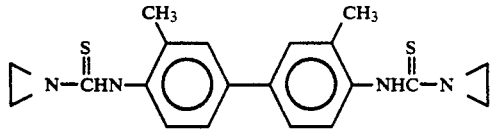 |
| 70) | 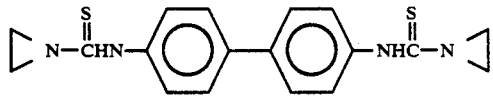 |
| 71) | 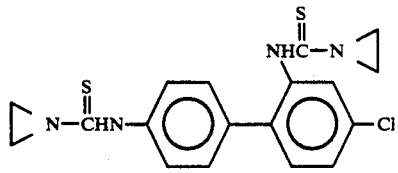 |

-continued

| Compound No. | Formula |
|---|---|
| 72) | 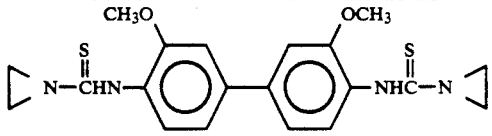 |
| 73) | 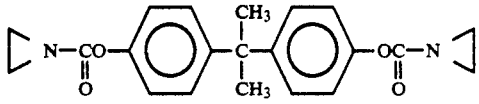 |
| 74) | 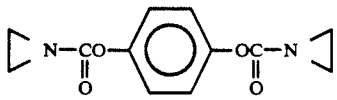 |
| 75) | 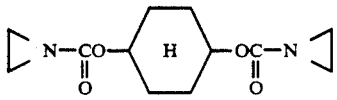 |
| 76) | 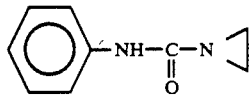 |
| 77) | 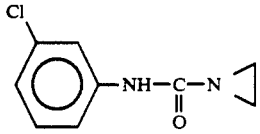 |
| 78) | 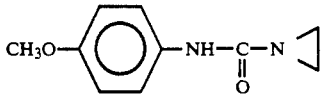 |

In the thermosensitive colored image-forming layer of the present invention, the dye precursor is preferably present in a dry amount of 2% to 40% based on the total weight of the colored image-forming layer, and the aziridine compound is preferably present in an amount of 5 to 800% by weight, more preferably 10 to 500% by weight, based on the weight of the dye precursor.

When the content of the aziridine compound is less than 5% by weight, the colored images formed on the resultant colored image-forming layer sometimes exhibit an unsatisfactory longtime persistency.

When the aziridine compound is used in an amount of more than 800% by weight, the resultant colored image-forming layer sometimes exhibits a saturated colored image-stabilizing effect and contains a non-reacted aziridine compound in an excessive amount, and thus is uneconomical.

The dye precursor usable for the present invention comprises at least one member selected from conventional triphenylmethane, fluoran and diphenylmethane leuco dyes, for example, 3-(4-diethylamino-2-ethoxyphenyl)-3-(1-ethyl-2-methylindole-3-il)-4-azaphthalide, crystal violet lactone, 3-(N-ethyl-N-isopentylamino)-6-methyl-7-anilinofluoran, 3-diethylamino-6-methyl-7-anilinofluoran, 3-diethylamino-6-methyl-7-(2',4'-dimenthyl-anilino) fluoran, 3-(N-ethyl-N-p-toluidino)-6-methyl-7-anilinofluoran, 3-pyrrolidino-6-methyl-7-anilinofluoran, 3-dibutylamino-6-methyl-7-anilinofluoran, 3-(N-cyclohexyl-N-methylamino)-6-methyl-7-anilinofluoran, 3-diethylamino-7-(o-chloroanilino)fluoran, 3-diethylamino-7-(m-trifluoromethylanilino) fluoran, 3-diethylamino-6-methyl-7-chlorofluoran, 3-diethylamino-6-methylfluoran, 3-cyclohexylamino-6-chlorofluoran and 3-(N-ethyl-N-hexylamino)-6-methyl-7-(p-chloroanilino) fluoran.

In the colored image-forming layer of the present invention, benzyl p-hydroxybenzoate is present preferably in an amount of 20 to 1000% by weight, more preferably 50 to 500% by weight, based on the weight of the dye precursor. When the benzyl p-hydroxybenzoate is used in an amount of less than 20% by weight, the resultant colored image-forming layer sometimes exhibits an unsatisfactory color density-enhancing effect on the resultant colored images. Also, the use of the benzyl p-hydroxybenzoate in a large amount of more than 1000% results in a saturation of the color density-enhancing effect and the persistency-improving effect on the resultant colored images, and thus is meaningless.

The color-developing agent optionally contains, in addition to benzyl p-hydroxybenzoate, at least one conventional acid compound, as long as the compound does not hinder the effect of the benzyl p-hydroxybenzoate and the aziridine compound.

Preferably, the conventional acid compound is present in an amount of 230% or less based on the weight of benzyl p-hydroxybenzoate, and selected from phenolic compounds and organic acid compounds, for example, 2,2-bis(4-hydroxyphenyl) propane(bisphenol A), 1,1-bis(4-hydroxyphenyl)-1-phenyl-ethane, 1,4-bis[1-methyl-1-(4'-hydroxyphenyl)ethyl] benzene, 1,3-bis[1-methyl-1-(4'-hydroxyphenyl)ethyl] benzene, dihydroxydiphenylether (JP-A-1-180,382), bis-phenol S, 4-hydroxy-4'-iso propyloxydiphenyl-sulfone(JP-A-60-13,852), 1,1-di(4-hydroxy-phenyl) cyclohexane, 1,7-di(4-hydroxyphenylthio)-3,5-dioxaheptane(JP-A-59-52,694), 3,3'-diallyl-4,4'-dihydroxydiphenyl-sulfone(JP-A-60-208,286).

The colored image-forming layer of the present invention contains a binder, preferably in an amount of 5 to 20% based on the total dry weight of the colored image-forming layer.

The binder preferably comprises at least one member selected from water-soluble polymeric materials, for example, various types of polyvinyl alcohol resins which have a different molecular weight from each other, starch and starch derivatives, cellulose derivatives, for example, methoxy cellulose, carboxymethyl cellulose, methyl cellulose and ethyl cellulose, sodium polyacrylate, polyvinyl pyrrolidine, acrylic acid amide-acrylic acid ester copolymers, acrylic acid amide-acrylic acid ester-methacrylic acid terpolymers, alkali salts of styrene-maleic anhydride copolymers, polyacrylic acid amide, sodium alginate, gelatine and casein, and water-insoluble polymeric materials, for example, polyvinyl acetate resins, polyurethane resins, styrene-butadiene copolymer resins, polyacrylic acid resins, polyacrylic acid ester resins, vinyl chloride-vinyl acetate copolymer resins, polybutyl methacrylate, ethylene-vinyl acetate copolymer resins and styrene-butadiene-acrylic compound terpolymer resins, which are used in the form of latexes.

The thermosensitive colored image-forming layer of the present invention optionally further comprises a heat-fusible organic substance, usually referred to as a sensitizing agent, inorganic and organic pigments, antioxidants, ultraviolet ray-absorbers, and waxes.

The sensitizing agent comprises at least one organic compound having a melting point of from 50° C. to 160° C., for example, phenyl 1-hydroxy-2-naphthoate (JP-A-57-191,089), p-benzyl-biphenyl (JP-A-60-82,382), benzyl-naphthylether (JP-A-58-87,094), dibenzyl terephthalate (JP-A-58-98,285), benzyl p-benzyloxybenzoate (JP-A-57-201,691), diphenyl carbonate, ditolyl carbonate (JP-A-58-136,489), m-terphenyl (JP-A-57-89,994), 1,2-bis(m-tolyloxy)ethane (JP-A-60-56,588), 1,5-bis(p-methoxyphenoxy)-3-oxapentane (JP-A-62-181,183), oxalic acid diesters (JP-A-64-1,583) and 1,4-bis(p-tolyloxy) benzene (JP-A-2-153,783).

The inorganic and organic pigments usable for the present invention are preferably selected from inorganic fine particles of, for example, calcium carbonate, silica, zinc oxide, titanium dioxide, aluminum hydroxide, zinc hydroxide, barium sulfate, clay, anhydrous clay, talc, and surface-treated calcium carbonate and silica and organic fine particles of, for example, urea-formaldehyde resins, styrene-methacrylate copolymer resins and polystyrene resins.

The antioxidants and ultraviolet ray-absorbers are preferably selected from 1,1,3-tris(3'-cycloxyl-4'-hydroxyphenyl)butane; 1,1,3-tris(2-methyl-4-hydroxy-5-tert-butylphenyl)butane, 4,4'-thio-bis(3-methyl-6-tert-butylphenol), 1,3,5-trimethyl-2,4-6-tris(3,5-di-tert-butyl-4-hydroxybenzyl)benzene, 2,2'-dihydroxy-4,4'-dimethoxybenzophenone, p-octylphenyl salycilate, 2-(2'-hydroxy-5'-methylphenyl)benzotriazole, ethyl-2-cyano-3,3'-diphenyl acrylate, and tetra(2,2,6,6-tetramethyl-4-piperidyl)-1,2,3,4-butane-tetracarbonate.

The waxes usable for the present invention preferably comprise at least one member selected from, for example, paraffin waxes, carnauba wax, microcrystalline waxes, polyethylene waxes, amide type waxes, bisimide type waxes, higher fatty acid amide waxes, for example, stearic acid amide, ethylene-bisstearoamide wax, higher fatty acid esters and metal salts, for example, zinc stearate, aluminum stearate calcium stearate and zinc oleate.

In the colored image-forming layer of the present invention, the sensitizing agent is preferably contained in an amount of 5 to 40% by weight, the wax and organic or inorganic pigment are optionally contained in amounts of 2 to 20% by weight and 5 to 50% by weight, respectively, and the antioxidant and ultraviolet ray-absorber are contained preferably in an amount of 1 to 10%, based on the total dry weight of the colored image-forming layer.

The sheet substrate usable for the present invention is not limited to a specific group of materials, and usually the sheet substrate comprises a member selected from fine paper sheets, coated paper sheet having a clay or plastic coating layer, cast-coated paper sheets, paper boards, plastic resin films, synthetic paper sheets comprising a plastic resin such as a polyolefin resin and a multi-layer structure, and laminated composite sheets. Preferably, the sheet substrate has a basis weight of 40 to 170 g/m$^2$.

The colored image-forming layer can be formed on a surface of a sheet substrate, by applying a coating liquid containing the above-mentioned components, and by drying and solidifying the coating liquid layer on the sheet substrate.

The colored image-forming layer is preferably present in a dry weight of from 1 to 15 g/m$^2$, more preferably 2 to 10 g/m$^2$.

In the present thermosensitive recording material, a protective layer and/or a printed layer may be formed on the colored image-forming layer.

The thermosensitive recording material of the present invention has an excellent storage persistency of the resultant colored images, a satisfactory suitability for a high speed recording machine, a high whiteness, and does not exhibit an undesirable white powder-forming phenomenon on the resultant colored images. Therefore the thermosensitive recording material of the present invention is fully balanced in quality thereof and very variable for practical use.

EXAMPLES

The present invention will be further explained by the following specific examples, which are merely representative and do not in any way restrict the scope of the present invention.

EXAMPLE 1

A thermosensitive recording paper sheet was prepared by the following procedures.

(1) Preparation of an aqueous dye precursor dispersion A in the following composition

| Component | Part by weight |
|---|---|
| 3-(N-isopentyl-N-ethylamino)-6-methyl-7-anilinofluoran | 20 |
| 10% aqueous solution of polyvinyl alcohol | 10 |

-continued

| Component | Part by weight |
|---|---|
| Water | 70 |

The composition was dispersed in a sand grinder to an extent such that the resultant dispersed solid particles had an average size of 1 μm or less.

(2) Preparation of an aqueous color-developing agent dispersion B in the following composition

| Component | Part by weight |
|---|---|
| Benzyl p-hydroxybenzoate | 20 |
| 10% aqueous solution of polyvinyl alcohol | 10 |
| Water | 70 |

The composition was dispersed in a sand grinder to an extent such that the resultant dispersed solid particles had an average size of 1 μm or less.

(3) Preparation of an aqueous aziridine compound dispersion C in the following composition

| Component | Part by weight |
|---|---|
| 4,4'-bis(1-aziridinocarbonyl-amino)diphenylmethane (Compound No. 33) | 20 |
| 10% aqueous solution of polyvinyl alcohol | 10 |
| Water | 70 |

The composition was dispersed in a sand grinder to an extent such that the resultant dispersed solid particles had an average size of 1 μm or less.

(4) Formation of thermosensitive colored image-forming layer

A coating liquid was prepared by evenly mixing parts by weight of the aqueous dye precursor dispersion A, 80 parts by weight of the aqueous color-developing agent dispersion B and 40 parts by weight of the aqueous aziridine compound dispersion C with 40 parts by weight of a calcium carbonate pigment, 25 parts by weight of a 25% aqueous zinc stearate dispersion, 30 parts by weight of a 30% aqueous paraffin dispersion, and 180 parts by weight of a 10% aqueous polyvinyl alcohol solution, by agitating the mixture.

A surface of a fine paper sheet having a basis weight of 50 g/m$^2$ was coated with the resultant coating liquid and dried. A thermosensitive colored image-forming layer was formed in a weight of 7.0 g/m$^2$, to provide a thermosensitive recording paper sheet.

The recording sheet was treated by a super calender, and the calendered surface of the recording sheet had a Bekk smoothness of 600 to 1000 seconds.

Specimens of the resultant thermosensitive recording sheet were subjected to measurements of the recording sensitivity, whiteness, and resistances thereof to an oily and fatty substance, and to a plasticizer, in the following manner.

(a) Recording sensitivity

A thermosensitive color image forming layer of a specimen was color-developed by a thermal inclination tester made by Toyoseiki Co., at a temperature of 120° C. under a pressure of 2.5 kg/cm$^2$ for 100 m seconds.

A color density of the resultant black colored images was measured by Macbeth Reflection Color Density Tester - 914 (trademark).

The recording sensitivity of the specimen was represented by the measured color density value.

(b) Whiteness

A reflectance of non-color developed portions of the colored image-forming layer of the specimen were measured by using a Hunter Whiteness Tester (trademark) with a blue filter.

The whiteness of the specimen was represented by the measured reflectance value.

(c) Resistance to oil

A color-developed specimen was coated with a cottonseed oil. The oil-coated specimen was left to stand at room temperature for 4 hours, and the cottonseed oil then wiped from the specimen, and the color density of the colored images retained on the specimen determined by a Macbeth Reflection Color Density Tester. The oil resistance of the colored images on the specimen was represented by the measured color density value.

(d) Plasticizer resistance (Resistance to polyvinyl chloride film)

A polyvinyl chloride film (available from Mitsuitoatsu Kagaku K.K.) was wound three times around a paper tube. A color-developed specimen was wound around the polyvinyl chloride film layer in such a manner that the colored image-forming layer of the specimen faced outward, and the same polyvinyl chloride film as mentioned above was wound three times around the specimen layer. The wound piece was left to stand at room temperature for 24 hours. The color density of the colored images retained on the tested specimen was measured by the Macbeth Reflection Color Density Tester.

The plasticizer resistance of the specimen was represented by the measured color density value.

The test results are shown in Tables 1 and 2.

EXAMPLE 2

The same procedures as in Example 1 were carried out except that, in the preparation of the aqueous aziridine compound dispersion C, 4,4'-bis(1-aziridinocarbonylamino)diphenylmethane was replaced by 2,4-bis(1-aziridinocarbonylamino)toluene (Compound No. 27).

The test results are shown in Tables 1 and 2.

EXAMPLE 3

The same procedures as in Example 1 were carried out except that, in the preparation of the aqueous aziridine compound dispersion C, 4,4'-bis(1-aziridinocarbonylamino)diphenylmethane was replaced by 1,1-ethylene-3-(2-naphthyl)urea (Compound No. 8).

The test results are shown in Tables 1 and 2.

EXAMPLE 4

The same procedures as in Example 1 were carried out except that, in the preparation of the aqueous aziridine compound dispersion C, 4,4'-bis(1-aziridinocarbonylamino)diphenylmethane was replaced by 1,4-bis(1-aziridinocarbonyl)benzene (Compound No. 19).

The test results are shown in Tables 1 and 2.

EXAMPLE 5

The same procedures as in Example 1 were carried out except that, in the preparation of the aqueous dye precursor dispersion A, 3-(N-isopentyl-N-ethylamino)-6-methyl-7-anilino-furan was replaced by 3-diethylamino-6-methyl-7-anilinofluoran.

The test results are shown in Tables 1 and 2.

EXAMPLE 6

The same procedures as in Example 1 were carried out except that, in the preparation of the aqueous dye precursor dispersion A, 3-(N-isopentyl-N-ethylamino)-6-methyl-7-anilinofuran was replaced by 3-dibutylamino-6-methyl-7-anilinofluoran.

The test results are shown in Tables 1 and 2.

COMPARATIVE EXAMPLE 1

The same procedures as in Example 1 were carried out except that the aqueous aziridine compound dispersion C was not employed for the thermosensitive colored image-forming layer.

The test results are shown in Tables 1 and 2.

COMPARATIVE EXAMPLE 2

The same procedures as in Example 1 were carried out except that, in the preparation of the aqueous color-developing agent dispersion C, benzyl p-hydroxybenzoate was replaced by bisphenol A.

The test results are shown in Tables 1 and 2.

COMPARATIVE EXAMPLES 3

The same procedures as in Example 1 were carried out except that, in the preparation of the aqueous aziridine compound dispersion C, 4,4'-bis(1-aziridinocarbonylamino)diphenylmethane was replaced by an antioxidant consisting of 1,1,3-tris(4'-hydroxy-2'-methyl-5'-cyclohexyl-phenyl)butane.

The test results are shown in Tables 1 and 2.

TABLE 1

| Example No | Item | Recording sensitivity | Whiteness | Oil resistance | Plasticizer resistance |
|---|---|---|---|---|---|
| Example | 1 | 1.31 | 81.3 | 1.13 | 1.05 |
| | 2 | 1.35 | 80.8 | 1.09 | 1.04 |
| | 3 | 1.31 | 80.9 | 1.07 | 1.02 |
| | 4 | 1.29 | 80.6 | 1.04 | 1.01 |
| | 5 | 1.38 | 80.0 | 1.15 | 1.10 |
| | 6 | 1.25 | 82.0 | 1.00 | 0.96 |
| Comparative Example | 1 | 1.30 | 77.0 | 0.30 | 0.35 |
| | 2 | 0.60 | 78.0 | 0.48 | 0.40 |
| | 3 | 1.28 | 76.0 | 0.31 | 0.33 |

TABLE 24

| Example No. | Item | White powder-forming phenomenon on colored images |
|---|---|---|
| Example | 1 | No white powder formed even after two months storage. |
| | 2 | No white powder formed even after two months storage. |
| | 3 | No white powder formed even after two months storage. |
| | 4 | No white powder formed even after two months storage. |

TABLE 24-continued

| Example No. | Item | White powder-forming phenomenon on colored images |
|---|---|---|
| | 5 | No white powder formed even after two months storage. |
| | 6 | No white powder formed even after two months storage. |
| Comparative Example | 1 | White power found after one week storage. |
| | 2 | No white powder formed even after two months storage. |
| | 3 | White powder found after two months storage. |

Tables 1 and 2 clearly indicate that the thermosensitive recording sheets of Examples 1 to 6 prepared in accordance with the present invention exhibited a satisfactory recording sensitivity and whiteness and an excellent storage persistency of the resultant colored images, whereas the thermosensitive recording sheets of Comparative Examples 1 to 3 were unsatisfactory in at least one item of the recording sensitivity, whiteness and storage persistency of the resultant colored images.

We claim:

1. A thermosensitive recording material comprising:

a sheet substrate; and a thermosensitive colored image-forming layer formed on the sheet substrate and comprising a substantially colorless dye precursor, a color-developing agent reactive with the dye precursor upon heating to develop a color, and a binder, said color-developing agent comprising benzyl p-hydroxybenzoate, and said thermosensitive colored image-forming layer further containing a colored image-stabilizing agent comprising at least one aziridine compound selected from the group consisting of aromatic aziridine compounds having, per one molecule thereof, an aziridine group and at least one aromatic cyclic group, and aromatic, aliphatic and cycloaliphatic aziridine compounds having, per one molecule thereof, at least two aziridine groups.

2. The thermosensitive recording material as claimed in claim 1, wherein the color-developing agent comprises the benzyl p-hydroxybenzoate in an amount of 30% to 100% based on the weight of the color-developing agent.

3. The thermosensitive recording material as claimed in claim 1, wherein the dye precursor is present in an amount of 2 to 40% based on the total weight of the thermosensitive colored image-forming layer, and the color-developing agent is present in an amount of 20 to 1000% based on the weight of the dye precursor.

4. The thermosensitive recording material as claimed in claim 1, wherein the colored image-stabilizing agent is present in an amount of 5 to 800% based on the weight of the dye precursor.

5. The thermosensitive recording material as claimed in claim 1, wherein the aziridine compound has a melting temperature of 50° C. or more.

* * * * *